US007544275B2

(12) United States Patent
Lamaze

(10) Patent No.: US 7,544,275 B2
(45) Date of Patent: Jun. 9, 2009

(54) DEVICE AND METHOD FOR CONNECTING INERT ANODES FOR THE PRODUCTION OF ALUMINUM BY FUSED-SALT ELECTROLYSIS

(75) Inventor: Airy-Pierre Lamaze, Reaumont (FR)

(73) Assignee: Aluminium Pechiney, Voreppe (FR)

( * ) Notice: Subject to any disclaimer, the term of this patent is extended or adjusted under 35 U.S.C. 154(b) by 212 days.

(21) Appl. No.: 10/569,546

(22) PCT Filed: Sep. 28, 2004

(86) PCT No.: PCT/FR2004/002451

§ 371 (c)(1),
(2), (4) Date: Mar. 17, 2006

(87) PCT Pub. No.: WO2005/033368

PCT Pub. Date: Apr. 14, 2005

(65) Prior Publication Data

US 2006/0163057 A1 Jul. 27, 2006

(30) Foreign Application Priority Data

Sep. 30, 2003 (FR) ..... 03 11444

(51) Int. Cl.
*C25B 11/02* (2006.01)

(52) U.S. Cl. ..... 204/280; 204/286.1; 204/291; 204/292; 204/294; 29/746; 29/747; 29/825

(58) Field of Classification Search ..... 204/280, 204/286.1, 291, 292, 294; 29/746, 747, 825

See application file for complete search history.

(56) References Cited

U.S. PATENT DOCUMENTS

| | | | | |
|---|---|---|---|---|
| 4,456,517 | A | 6/1984 | Rolf | |
| 4,495,049 | A * | 1/1985 | Secrist et al. | 204/292 |
| 5,172,850 | A | 12/1992 | Prengaman et al. | |
| 6,264,810 | B1 | 7/2001 | Stol | |
| 6,558,526 | B2 * | 5/2003 | D'Astolfo et al. | 205/389 |

FOREIGN PATENT DOCUMENTS

| | | |
|---|---|---|
| CA | 1246493 | 12/1988 |
| SU | 1062313 | 12/1983 |
| SU | 1735438 | 5/1992 |

* cited by examiner

*Primary Examiner*—Bruce F Bell
(74) *Attorney, Agent, or Firm*—Dennison, Schultz & MacDonald

(57) ABSTRACT

This invention relates to an anode assembly (1) to be used in a fused bath electrolysis aluminium production cell. This assembly comprises one inert anode (2) in the shape of a ladle, one connection conductor (3, 4, 5), mechanical connection means capable of cooperating so as to set up a mechanical link between the conductor and the anode, one metallic joint (31) that is or could be formed by brazing being located between all or part of at least one surface (20, 20', 20") of the open end (22) of the anode (2) and all or part of at least one surface (40, 40', 40") of the connection end (42) of the conductor (3, 4, 5). The invention simplifies manufacturing of anode assemblies comprising one inert anode.

37 Claims, 7 Drawing Sheets

DEVICE AND METHOD FOR CONNECTING INERT ANODES FOR THE PRODUCTION OF ALUMINUM BY FUSED-SALT ELECTROLYSIS

This application is a filing under 35 USC 371 of PCT/FR2004/002451, filed Sep. 28, 2004.

FIELD OF THE INVENTION

The invention relates to the production of aluminium by fused bath electrolysis. It particularly concerns anodes used for this production and the electrical connection of these anodes to current input conductors.

DESCRIPTION OF RELATED ART

Metal aluminium is produced industrially by fused bath electrolysis, namely by electrolysis of alumina in solution in a bath based on molten cryolite, called an electrolytic bath, particularly using the well-known Hall-Héroult process. The electrolysis is done in cells comprising a crucible made of a refractory material capable of containing the electrolyte, at least one cathode and at least one anode.

The electrolysis current that circulates in the electrolyte through the anodes and cathodes causes alumina reduction reactions and is also capable of maintaining the electrolyte bath at the target operating temperature, typically of the order of 950° C., by the Joule effect. The electrolysis cell is regularly supplied with alumina so as to compensate for consumption of alumina caused by electrolysis reactions.

In the standard technology, anodes are made of a carbonaceous material and are consumed by aluminium reduction reactions. Consumption of the carbonaceous material releases large quantities of carbon dioxide.

Aluminium producers have been searching for anodes made of non-consumable materials, called "inert anodes", for several decades, to avoid environmental problems and costs associated with manufacturing and use of anodes made of carbonaceous material. Several materials have been proposed, particularly ceramic materials (such as $SnO_2$ and ferrites), metallic materials and composite materials such as materials known as "cermets" containing a ceramic phase and a metallic phase, particularly nickel ferrites containing a metallic copper-based phase.

Problems encountered in the development of inert anodes for the production of aluminium by electrolysis lie not only in the choice and manufacturing of the material from which the anode is made, but also in the electrical connection between each anode and the conductor(s) that will be used for the electrical power supply of the electrolytic cell. Several methods and devices have been proposed for the connection of inert anodes.

U.S. Pat. No. 4,500,406 proposes to use anodes with an active part, a metallic part suitable for connection, and a composition gradient between the active part and the metallic part. U.S. Pat. No. 4,541,912 describes an assembly formed by hot isostatic compression of a cermet material on a metallic conducting substrate. These solutions make it more difficult to make the anode and impose constraints on baking parameters for the active part of the anode.

American patent U.S. Pat. No. 4,623,555 describes the formation of a connection using a composition gradient formed by plasma sputtering. This solution requires perfect control of the process for formation of the intermediate layer and imposes a complex additional step.

Patents U.S. Pat. No. 4,468,298, U.S. Pat. No. 4,468,299 and U.S. Pat. No. 4,468,300 describe joints formed by diffusion, friction or other welding. Patent U.S. Pat. No. 4,457,811 describes a connection comprising one or several elastic strips welded on the inner or outer surface of an anode. These solutions require a chemical reduction of the contact surface before formation of the joints, considerably complicating manufacturing of the anodes. Another disadvantage of these solutions is that they complicate the assembly of the electrical connections.

American patents U.S. Pat. No. 4,357,226 and U.S. Pat. No. 4,840,718 describe mechanical connections applicable to solid anode assemblies. These connection methods are complex.

American patents U.S. Pat. No. 4,456,517, U.S. Pat. No. 4,450,061, U.S. Pat. No. 4,609,249 and U.S. Pat. No. 6,264,810 describe mechanical connections applicable to anodes with a central cavity. These connections are sensitive to changes in the mechanical properties of its constituent elements when the anodes are used, and introduce mechanical tensions between the anode and the metallic parts. Moreover, these solutions are sensitive to the corrosive ambient atmosphere of the electrolytic cells. In order to overcome this difficulty, some of these patents also propose to add screens and/or inert filling materials. These complementary protection means complicate the manufacture of connections and make it more expensive. The solution proposed in patent U.S. Pat. No. 6,264,810 has the additional disadvantage that it requires a large number of distinct parts that must maintain their mechanical characteristics over a long period of time.

Therefore, the applicant searched for solutions to overcome the disadvantages of prior art.

SUMMARY OF THE INVENTION

An object of the invention is an anode assembly comprising at least one inert anode and at least one connection conductor intended for the electrical power supply of the anode, characterized in that:

- the anode is hollow and is in the form of a ladle,
- the contact surface between the conductor and the anode is close to the aperture of the anode (typically near the periphery),
- the electrical and mechanical link between the conductor and the anode comprises a brazed metal joint that could be formed by fully or partly brazing during use.

In one advantageous embodiment of the invention, the said brazed joint could be consolidated during use of the said assembly in an electrolytic aluminium production cell. It advantageously achieves this by including at least one element chosen from among aluminium, silver, copper, magnesium, manganese, titanium and zinc.

The anode is typically in the shape of a cylindrical ladle or a "glove finger", for which the outer surface of the closed end is rounded or is a rounded quadrangle in which the corners of the outer surface of the closed end are rounded. These shapes avoid disparities of local current density during use, when the closed end is immersed in an electrolyte bath based on molten salt.

The applicant has noted that known connection modes that carry electrical power directly to the centre or close to the part immersed in the bath, entrain poor distribution of current lines, particularly in anodes in the shape of a ladle. The applicant has also noted that this distribution of current lines could lead to current densities that are too low at some locations (in other words typically less than about 0.5 $A/cm^2$), which facilitates local corrosion, and is too high (in other words typically more than 1.5 A/cm$^2$, or even more than 2.5 A/cm$^2$) at other locations, which locally accelerates degradation by electrochemical dissolution.

The applicant had the idea of using a brazed joint that increases in strength during a heat treatment, either (wholly or partly) before use of the assembly in an electrolytic cell, or (wholly or partly) in situ during use of the assembly in an electrolytic cell. The brazed joint avoids applying a mechanical tension on part of the inert anode used for the mechanical connection. The brazed joint results in a common and efficient mechanical and electrical connection, which considerably simplifies the manufacturing process. This variant is also advantageous due to the fact that it enables the use of a mechanical assembly that is sized so that it is sufficient to temporarily and satisfactorily hold the anode in place mechanically until the brazed joint has gained strength, but is not necessarily capable of satisfying all mechanical needs of the connection required during use, since the increase in strength of the brazed joint provides the additional mechanical strength required in use.

Another object of the invention is a method for manufacturing anode assemblies according to the invention.

Another object of the invention is the use of at least one anode assembly according to the invention, or obtained by the manufacturing process according to the invention, for the production of aluminium by fused bath electrolysis.

Another object of the invention is a cell for producing aluminium by fused bath electrolysis comprising at least one anode assembly according to the invention or obtained by the manufacturing process according to the invention.

BRIEF DESCRIPTION OF THE DRAWINGS

The invention will be better understood after reading the detailed description of particular embodiments and the attached figures.

FIGS. 1 and 3 to 6 illustrate anode assemblies according to the invention, seen in a longitudinal section. FIG. 2 illustrates two elements of the anode assembly in FIG. 1. FIG. 6A shows the connection conductor and the anode, each having an annular shoulder separated by a spacing G when hot, which spacing enables the anode to be inserted into the conductor. FIG. 6B shows the connection conductor and the anode having shoulders that are inserted one into the other to provide temporary mechanical support when cold, until the brazed material has increased in strength. FIGS. 7A and 7*b* illustrate the morphological change of the brazing material during brazing. FIG. 7A shows the brazing material having a determined initial shape and position. FIG. 7B shows deformation during the heat treatment to occupy a final volume in contact with the connection surfaces.

DESCRIPTION OF THE PREFERRED EMBODIMENTS

Figure 1:
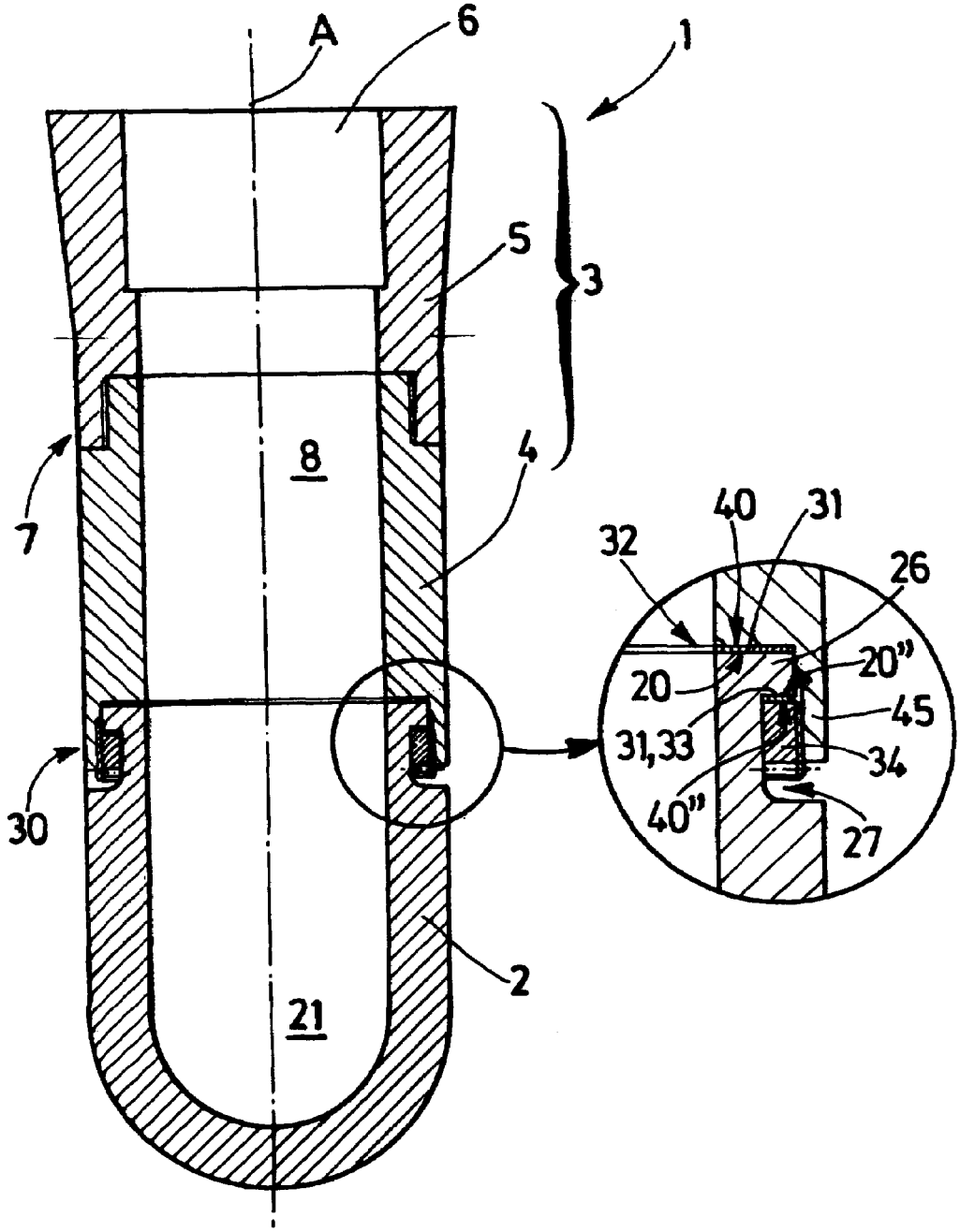
FIGS. 1 to 7 relate to the invention.
Figure 2:
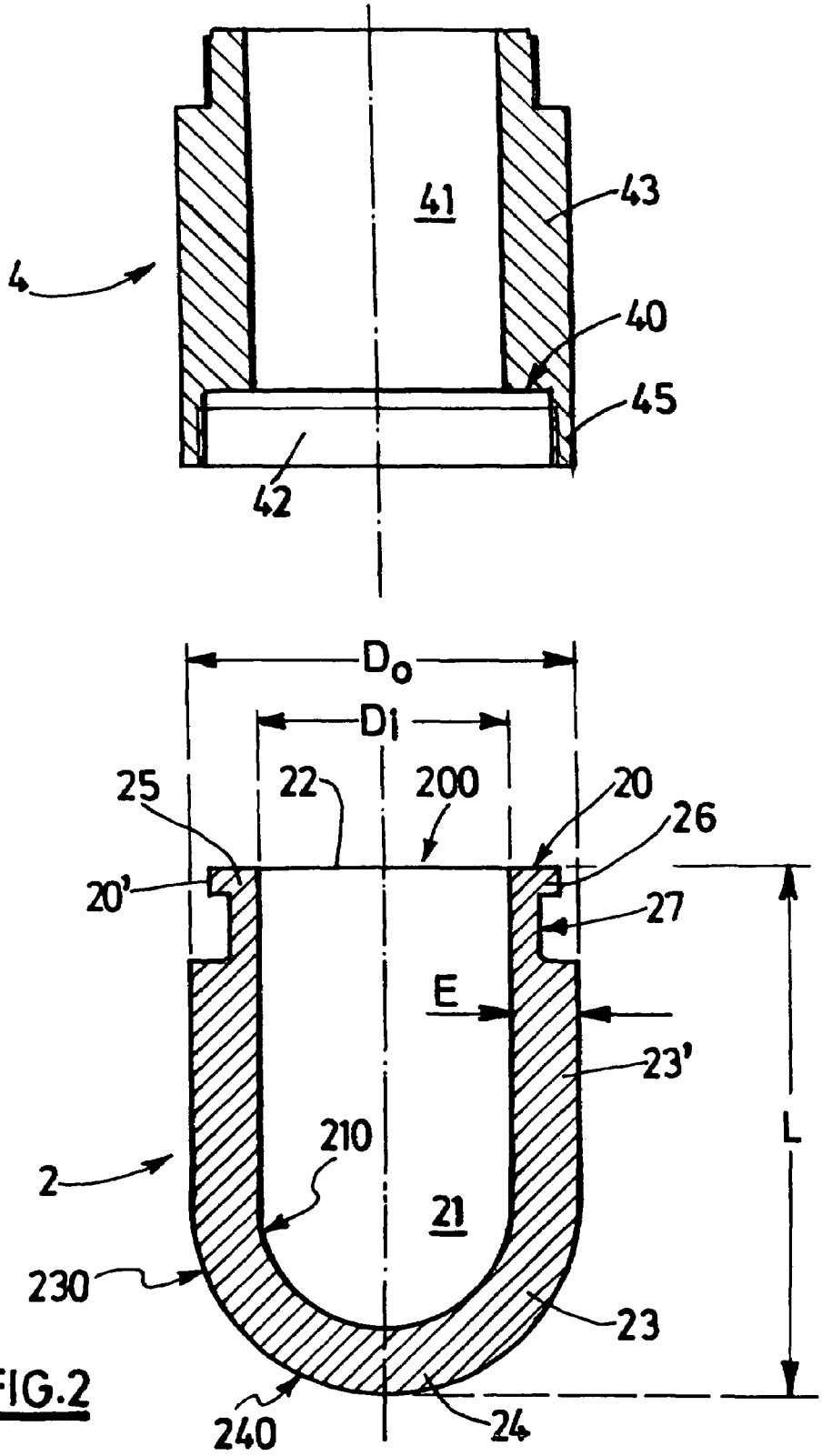

The anode assembly according to the invention comprises at least one hollow inert anode (2), at least one connection conductor (3, 4, 4', 5) and at least one brazed metallic joint, or joint that could be formed by brazing, (31) capable of providing a mechanical and electrical connection (30) between the conductor and the anode.

The hollow shape of the anode limits the manufacturing cost and releases a useful space (21) inside the anode. For example, this space or cavity (21) may be used to put in one or several heating resistances (9) that can be used to heat the anode before it is immersed in the liquid electrolyte bath.

The anode has an inner surface (210) and an outer surface (230). The thickness E of the wall (23) of the anode may be different at different locations of the anode. The thickness of the lateral part (23') of the wall (23) of the anode may or may not be uniform.

In one particular embodiment of the invention, the anodes and the connection conductors are axially symmetric about a central axis A.

The closed end (24) of the anode (2) has a so-called "active" surface (240) that will be immersed into an electrolyte bath based on molten salt. The active surface (240) of the anode is preferably free of sharp corners in order to prevent point effects in the distribution of the electrical current during use: it may be hemispherical or it may include polygons with rounded corners.

According to the invention, the open end (22) of the anode (2) that is opposite the closed end (24) is used to make a mechanical and electrical connection to at least one connection conductor (3, 4, 4', 5). The joint (31) is at the connection area (25) of the anode.

More precisely, the anode assembly (1) to be used in a fused bath electrolysis aluminium production cell according to the invention comprises:

- at least one inert anode (2) in the shape of a ladle, with length L, comprising a cavity (21), an open end (22) comprising an opening (200), a wall (23) surrounding the cavity (21), a closed end (24) and at least one mechanical connection means (26, 27, 28, 29);
- at least one connection conductor (3, 4, 4', 5) comprising a connection end (42) and at least one mechanical connection (44, 45, 46) capable of cooperating with the mechanical connection means (26, 27, 28, 29) of the anode (2) so as to set up a mechanical link between the conductor and the anode;
- at least one brazed metallic joint (31) or at least one brazing material that could form a brazed metallic joint (31) by brazing wholly or partly during use, the said joint (31) being located between all or part of at least one surface (20, 20', 20") of the open end (22) of the anode (2) and all or part of at least one surface (40, 40', 40") of the connection end (42) of the conductor (3, 4, 4', 5).

Advantageously, the anode assembly elements according to the invention, and particularly the said mechanical connection means (26, 27, 28, 29, 44, 45, 46), may be sized so as to be sufficient to provide satisfactory temporary mechanical support of the anode until the brazed joint has gained strength, before use or during use in an electrolytic cell.

The said joint (31) is located between all or part of at least one surface (20, 20', 20") of the open end (22) of the anode (2) and all or part of at least one surface (40, 40', 40") of the connection end (42) of the conductor (3, 4, 4', 5).

The connection conductor (3, 4, 4', 5) will be used to supply electrical power to the anode (2). It may comprise a central cavity (8). The connection conductor (3, 4, 4', 5) may be formed in several parts, and advantageously comprises at least one member (4) made of a nickel based alloy (in other words containing more than 50% by weight of nickel) and the connection end (42) is advantageously located on this member (4). The nickel based alloy is advantageously an UNS N06625 alloy called a "625 alloy" and is more advantageously an UNS N06025 alloy, called a "602 alloy", for which the content of added aluminium gives better resistance to corrosion when hot.

Figure 3:
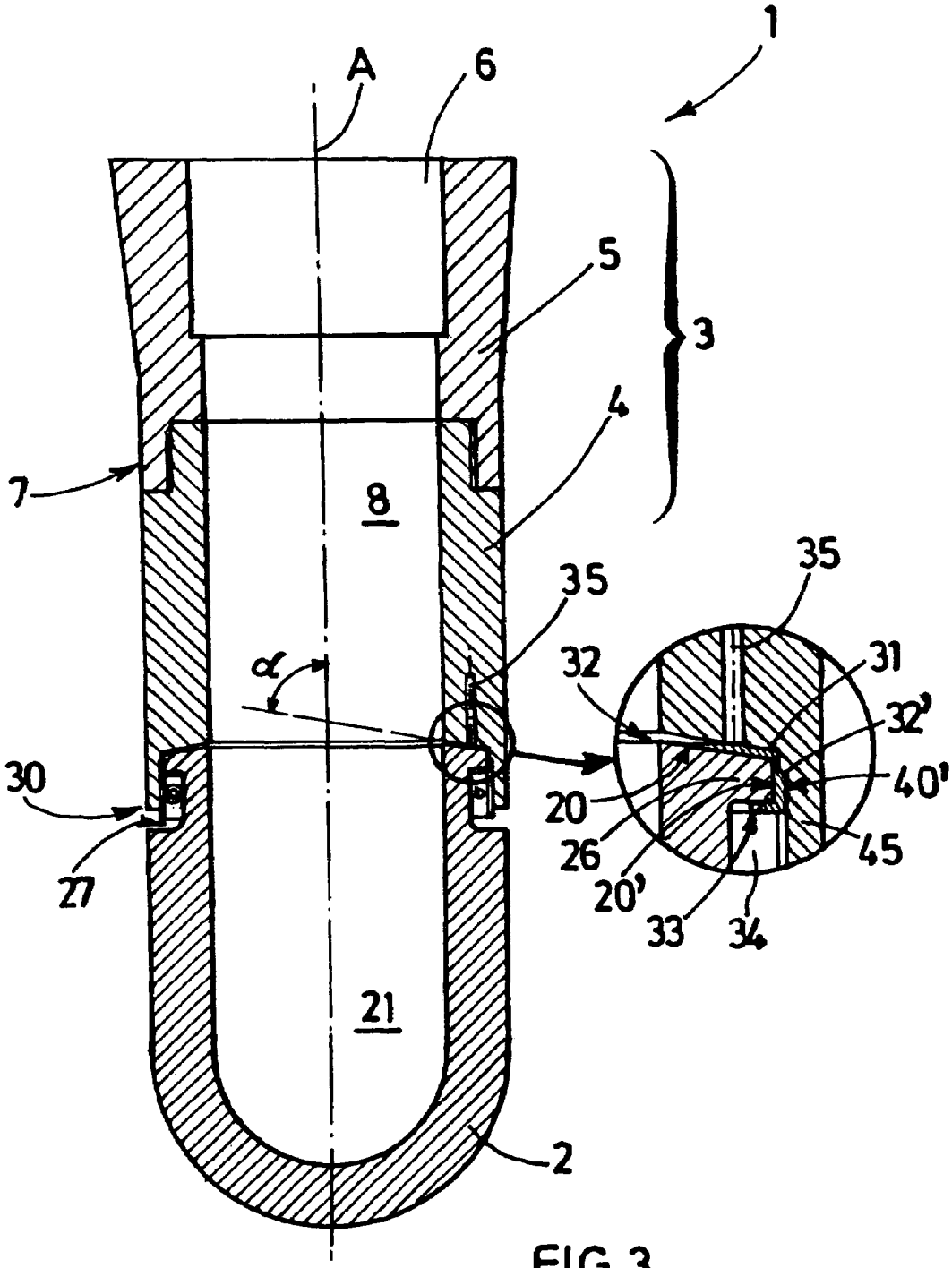
Figure 4:
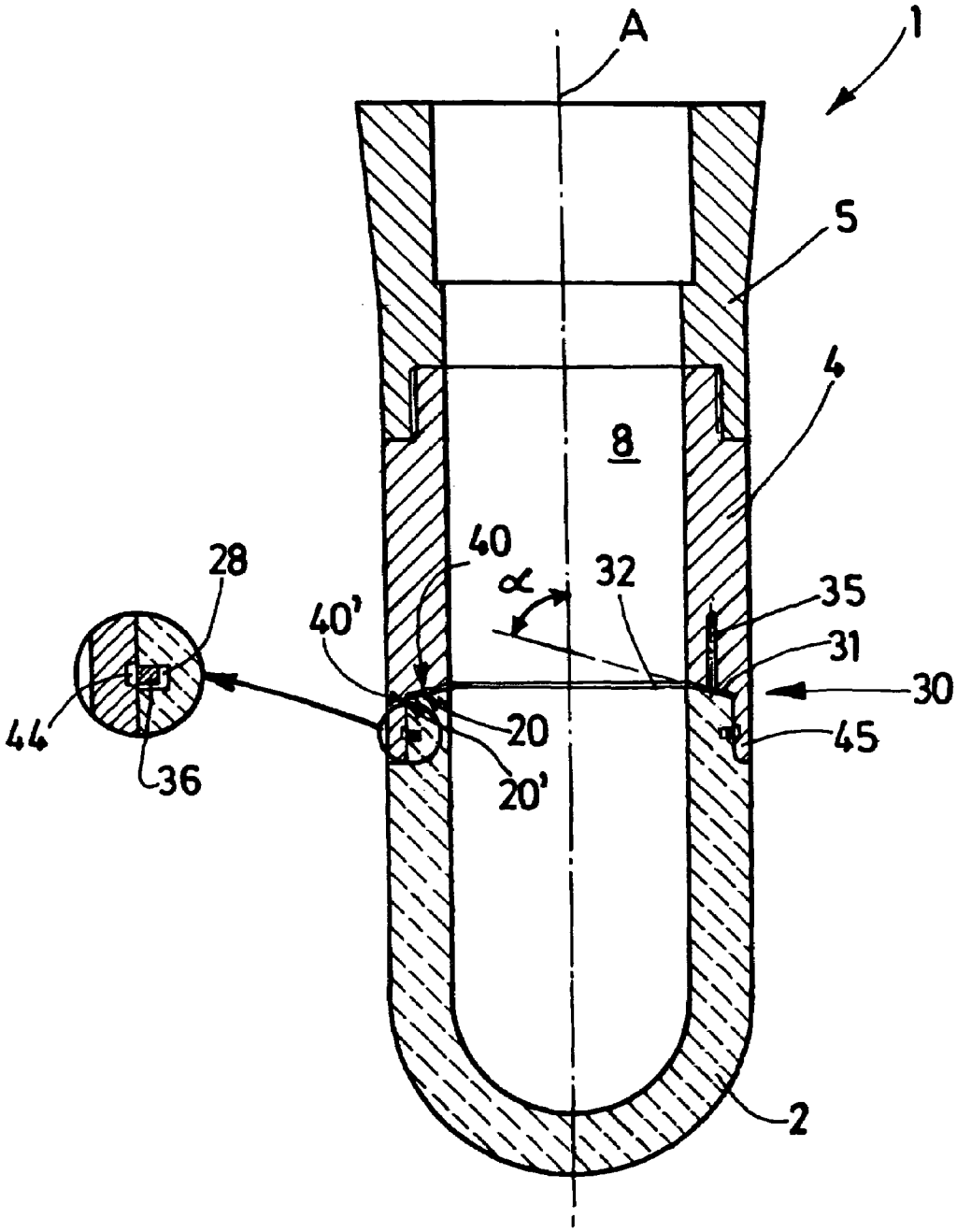
Figure 5:
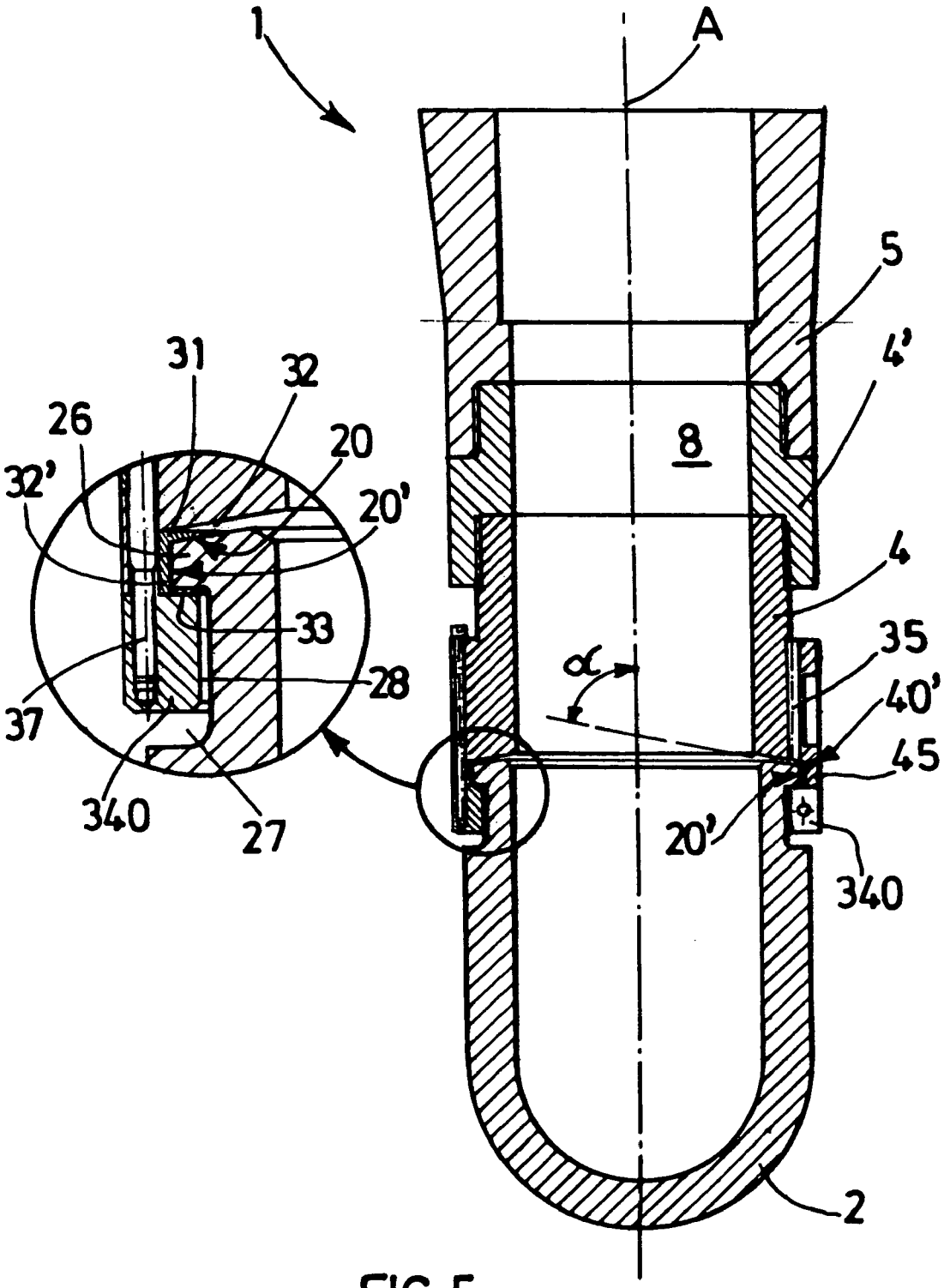

As illustrated in FIGS. 1, 3 and 4, the connection conductor (3, 4, 4', 5) may comprise an intermediate conductor (4), typically made of a nickel based alloy, designed to create a mechanical and electrical connection with the anode, and an "external" conductor (5) designed for the mechanical support of the anode assembly and electrical connection outside the electrolytic cell, usually by an external connection means (6). As illustrated in FIG. 5, the connection conductor (3, 4, 4', 5) may comprise two or several intermediate conductors (4, 4'). The parts (3, 4, 4', 5) are fixed to each other by one or several intermediate connections (7).

The shape of the connection conductor (3, 4, 4', 5) is typically elongated and possibly tubular.

The mechanical connection means (26, 27, 28, 29) of the anode (2) is/are located close to the open end (22). They cover part of the open end (22) of the anode, typically representing less than 10% or even less than 5%, of the total length L of the anode.

In order to provide a sufficient electrical contact, the total area of the connection surface(s) (20, 20', 20") of the anode is such that the current density per unit area at the nominal intensity during use, is preferably between 1 and 50 A/cm$^2$, more preferably between 2 and 20 A/cm$^2$, and even more preferably between 5 and 15 A/cm$^2$. These areas are typically between 1 and 20%, or even between 5% and 15%, of the total area of the external surface (230) of the anode.

The mechanical connection means (26, 27, 28, 29) of the anode (2) typically comprise(s) at least one element chosen from among the collars (26), annular cavities (27), annular grooves (28) and annular shoulders (29). These shapes are easy to obtain on inert anodes with axial symmetry.

The mechanical connection means (44, 45, 46) of the conductor (3, 4, 4', 5) is/are preferably close to the connection end (42).

The mechanical connections means (44, 45, 46) of the conductor (3, 4, 4', 5) typically comprise(s) at least one element chosen from among annular grooves (44), skirts (45) and annular shoulders (46). These shapes are easy to obtain—typically by screw cutting—on mechanical parts with axial symmetry.

The anode connection means (26, 27, 28, 29) and the conductor connection means (44, 45, 46) advantageously cooperate through at least one of the means chosen among screwing, click fitting, friction, insertion or force fitting. Insertion and force fitting may be done after heating the anode and/or the connection conductor.

The anode assembly (1) may comprise one or several complementary assembly means (34, 340, 36) such as one or more clamping rings (34, 340) and one or more open or closed rings (36).

The connection surfaces (20) close to the opening (200) of the anode (2) are advantageously inclined (typically from the assembly axis A) so as to prevent flow of the brazing material (31') in the cavity (21) during brazing and/or use of the anode assembly. For that purpose, the connection surface(s) (20, 20', 20") of the anode (2) typically comprise at least one flat surface element (20) for which the tangent forms an angle $\alpha$ between 45° and 90°, or even between 60° and 90°, with the main axis A of the anode.

The connection surfaces (20, 20', 20") are typically at least partly on the external surface (230) of the anode (2) when the coefficient of expansion of the material from which the anode is made is less than the coefficient of expansion of the material from which the connection conductor is made; otherwise, they are typically at least partly on the inner surface (210) of the anode.

The anode assembly (1) may also comprise at least one complementary seal (33) designed to confine the brazed joint (31), generally by limitation of the flow of the brazing material. This flow may take place during the heat treatment or during use. The complementary seal (33) is typically chosen from among open or closed rings and O-rings. The complementary seal (33) may be metallic or non-metallic.

Preferably, assembly of the conductor (3, 4, 4', 5) and the anode (2) does not involve any tightening or stress between the anode and the conductor, to limit the development of mechanical tensions before and/or during brazing.

Preferably, during use, the connection means (26, 27, 28, 29, 44, 45, 46) are located in a part of the cell at least partially isolated from corrosive gases and at a temperature significantly lower than the bath temperature (and preferably less than 850° C.), which is done by adaptation of the length L of the inert anode.

In the embodiments illustrated in FIGS. 1, 3 and 5, the periphery of the opening (200) of the anode (2) comprises a collar (26) facing the outside of the anode and an annular cavity (27) also facing the outside of the anode. The connection conductor (3, 4, 5) comprises a skirt (45) threaded on the inside. The connection means also comprise a clamping ring (34) threaded on the outside and that can be screwed inside the skirt (45).

In the embodiment shown in FIG. 1, the metallic joint (31) is formed from a brazing material in the form of a thin and flat ring, placed in the space (32) between the connection surfaces (20, 20") and (40, 40"). The connection means may comprise a ring (33) to limit the flow of the brazing material. Before the brazing operation, the threaded clamping ring (34) is screwed inside the skirt (45) so as to bring the connection surfaces (20, 20") and (40, 40") close to the brazing ring (31). The connection surfaces may possibly be put into contact with or may bear on the brazing ring.

As illustrated in FIGS. 3 to 5, the metallic joint (31) may be formed from a brazing material originating wholly or partly from at least one reservoir (35). The space (32, 32") is designed to accumulate brazing material and to form a joint (31) during brazing. The surface (20) close to the opening (200) is preferably inclined so as to prevent the brazing material from flowing into the anode cavity (21).

In the embodiment shown in FIG. 3, before the brazing operation, the threaded tightening ring (34) is screwed inside the skirt (45) so as to bring the connection surfaces (20, 20') and (40, 40') close to each other while leaving a space (32, 32') in which brazing material will accumulate, and to form a joint (31) during brazing.

In the embodiment shown in FIG. 4, the periphery of the opening (200) of the anode (2) comprises an annular groove (28) facing the outside of the anode. The connection conductor (3, 4, 5) comprises a skirt (45) provided with an annular groove (44) facing inwards. The connection means also comprise a click fit ring (36) capable of cooperating with annular grooves (28) and (44) so as to set up a mechanical link between the conductor (4) and the anode (2). In these embodiments, the anode (2) is inserted inside the skirt (45) until click fitting into grooves (28) and (44) before the brazing operation. There is a space (32) between the connection surfaces (20, 20') and (40, 40').

In the embodiment illustrated in FIG. 5, the periphery of the opening (200) of the anode (2) comprises a collar (26) facing the outside of the anode and an annular cavity (27) also facing the outside of the anode. The connection conductor (3, 4, 4', 5) comprises a skirt (45) on which a clamping ring (340) can be fitted, typically using attachment means (37) such as bolts. Before the brazing operation, the clamping ring (340) is fixed to the skirt (45) so as to trap the collar (26) while leaving a space (32, 32') designed to accumulate the brazing material and to form a joint (31) during brazing. The junction between the conductor (4) and the anode (2) remains loose until brazing.

In the embodiments shown in FIGS. 1, 3 and 5, the connection means may comprise a ring (FIGS. 1 and 5) or a O-ring (FIG. 3) (33) to limit flow of the brazing material.

Figure 6:
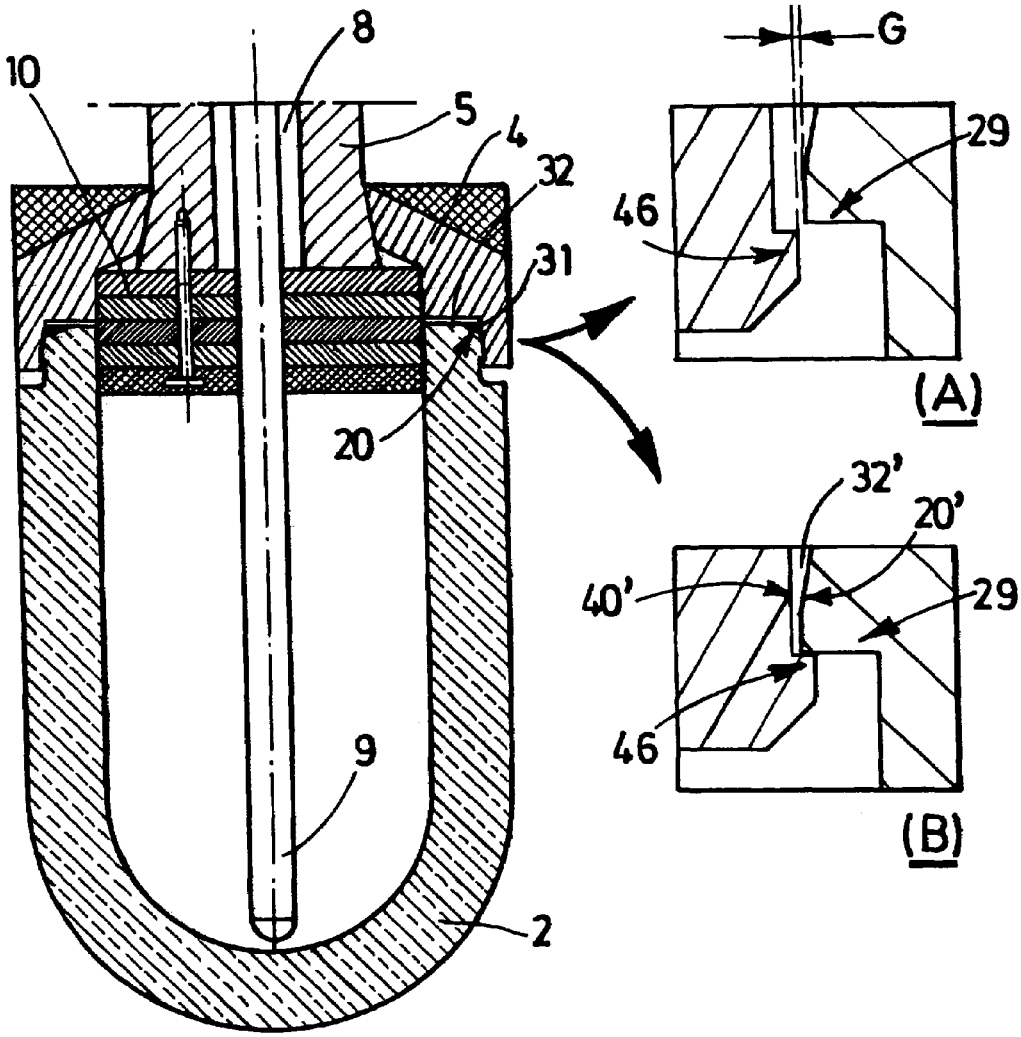

In the embodiment shown in FIG. 6, the connection conductor (4) is provided with an annular shoulder (46) capable of cooperating with a corresponding annular shoulder (29) on the anode (2). The dimensions of these shoulders are such that the assembly can be made by hot expansion of one of the two parts: (A) when hot, the space G between the parts is large enough to enable the anode to be inserted into the conductor; (B) when cold, the shoulders are inserted one into the other to provide temporary mechanical support until the brazed joint (31) has increased in strength. The heating temperature for assembly is preferably lower than the melting temperature of the brazing material to prevent it from flowing during assembly.

As in the case of the configuration shown in FIG. 6, the space (32') between some surfaces facing each other (20', 40') that will be brazed may be substantially vertical or conical.

Figure 7:
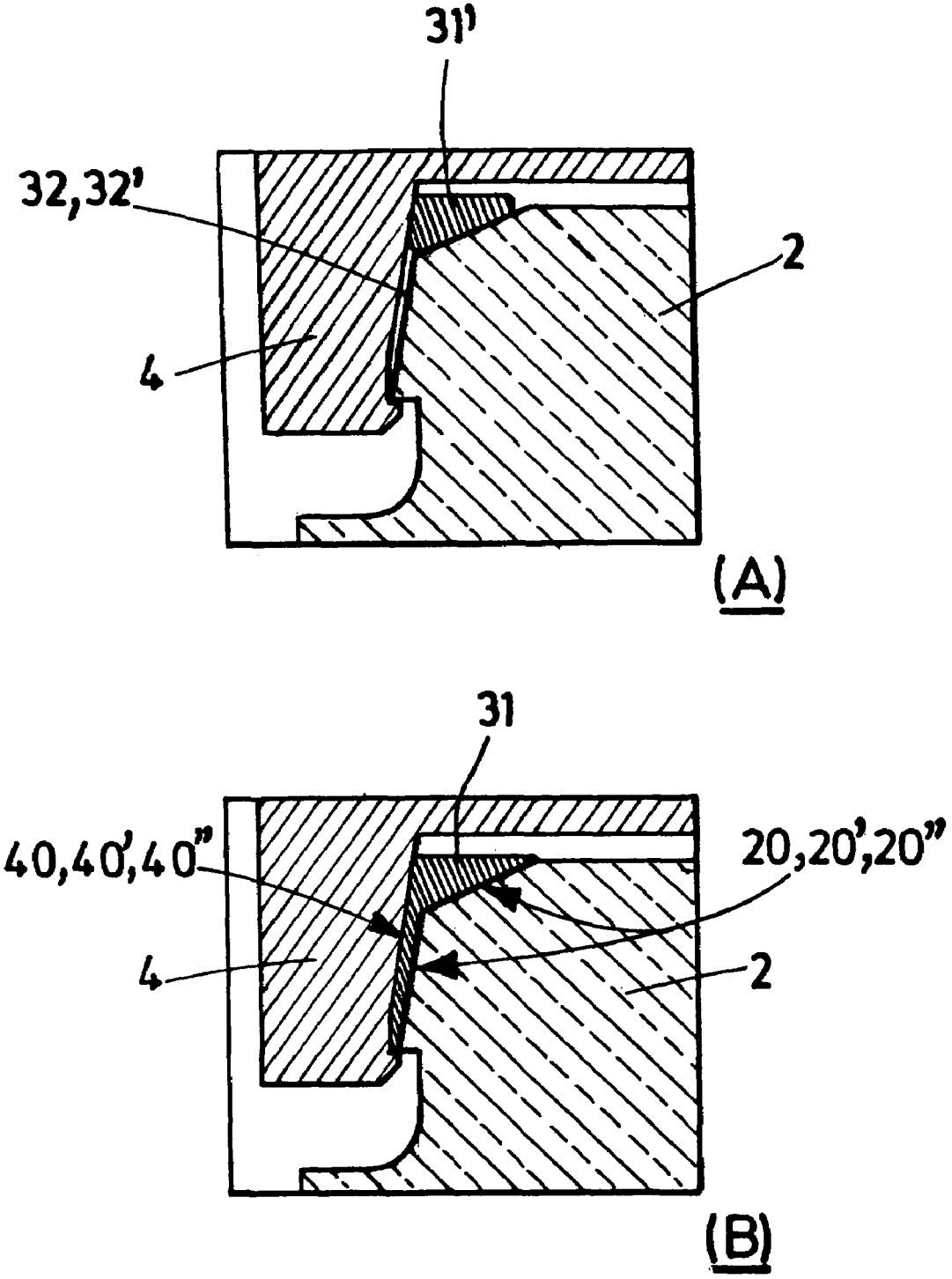

The position and shape of the brazing material may change during brazing. Thus, as illustrated in FIG. 7, the brazing material that has a determined initial shape and position (31') (FIG. 7A) may deform during the heat treatment, typically by flowing, to occupy a final volume (31) in intimate contact with the connection surfaces (20, 20', 20", 40, 40', 40") (FIG. 7B). The initial position may be wholly or partly in a reservoir (35).

The anode assembly may comprise a thermal insulation (10) in the central cavity (21) of the anode, particularly in order to prevent overheating of the external connection conductor (5) due to internal radiation of the anode.

The anode (2) is typically chosen from among anodes comprising a ceramic material, anodes comprising a metallic material and anodes comprising a cermet material.

The manufacturing method for an anode assembly (1) according to the invention comprises:

- the supply of at least one inert anode (2) in the form of a ladle, with length L, comprising a cavity (21), an open end (22) comprising an opening (200), a wall (23) surrounding the cavity (21), a closed end (24) and at least one mechanical connection means (26, 27, 28, 29):
- the supply of at least one connection conductor (3, 4, 4', 5) comprising a connection end (42), and at least one mechanical connection means (44, 45, 46) capable of cooperating with the mechanical connection means (26, 27, 28, 29) of the anode (2) so as to set up a mechanical connection between the conductor and the anode;
- the supply of at least one brazing material capable of forming a metallic joint;
- placement of the brazing material(s) at a determined location close to at least one of the surfaces (20, 20', 20") of the open end (22) of the anode (2) or the surfaces (40, 40', 40") of the connection end (42) of the conductor (3, 4, 4', 5) that will be connected by brazing;
- assembly of the conductor (3, 4, 4', 5) and the anode (2) so as to bring the said surfaces (20, 20', 20", 40, 40', 40") close to each other;
- a heat treatment capable of causing the formation of a brazed joint (31) between the conductor and the anode starting from the brazing material(s).

The brazed joint (31) is formed between the said surfaces (20, 20', 20", 40, 40', 40") and thus forms a mechanical and electrical connection between the conductor and the anode.

The assembly operation of the conductor (3, 4, 4', 5) and the anode (2) preferably produces a loose assembly, which will only become rigid during the heat treatment. This variant avoids mechanical stresses.

According to one advantageous embodiment of the invention, the composition of the brazing material, or one of the brazing materials, may be modified during the heat treatment so as to increase the melting temperature up to a value greater than the maximum temperature applied to the said brazed joint (31) during use. This modification strengthens the joint. It may be obtained by at least one of the following mechanisms:

- evaporation of at least one part of one of its constituent elements, the said element for example being zinc or magnesium;
- chemical reaction of at least part of one of its said constituent elements with one of the constituents of the ambient atmosphere, particularly oxygen. For example, the said constituent element could be aluminium, zinc, magnesium or phosphorus;
- exchange by diffusion, with or without oxidation—reduction reaction, of at least one element with one of the said surfaces (20, 20', 20", 40, 40', 40"). The exchange may take place from the brazing material to the adjacent surface and/or from the adjacent surface to the brazing material. In the latter case, all or part of the said surfaces (20, 20', 20", 40, 40', 40") can be coated with a material comprising an element such as nickel, that can diffuse in the brazing material. The exchange can possibly take place by oxidation—reduction reactions. More precisely, the said composition may contain at least one element that could be exchanged by at least one oxidation—reduction reaction with the said inert anode (2), the said element typically being chosen from among magnesium, aluminium, or phosphorus, titanium, zirconium, hafnium or zinc.

These mechanisms may be obtained with brazing materials chosen from among alloys or mixtures containing copper, silver, manganese and/or zinc.

The said surfaces (20, 20', 20", 40, 40', 40") may be fully or partly coated with a material that can be wetted by the brazing material(s).

According to one advantageous variant of the invention, the brazing material(s) are wholly or partly inserted into the space that separates the surfaces (20, 20', 20") and (40, 40', 40") that will be brazed. In other words, the said placement includes introduction of at least part of the brazing materials between all or part of at least one surface (20, 20', 20") of the open end (22) of the anode (2) and all or part of at least one surface (40, 40', 40") of the connection end (42) of the conductor (3, 4, 4', 5).

According to another advantageous variant of the invention, the conductor (3, 4, 4', 5) includes at least one reservoir (35), the said placement includes the introduction of at least one brazing material into at least one reservoir (35) before the heat treatment, and the conductor (3, 4, 4', 5) and the anode (2) are assembled so as to leave a free space (32, 32') between the conductor and the anode. The brazing material(s) is (are) introduced between all or part of at least one surface (20, 20', 20") of the open end (22) of the anode (2) and all or part of at least one surface (40, 40', 40") of the connection end (42) of the conductor (3, 4, 4', 5) by flow of the said material during the heat treatment.

The heat treatment is advantageously performed while the anode assembly (1) is being used in an electrolytic cell.

The known connection modes are at the temperature of the immersed part of the anode and therefore close to the temperature of the electrolytic bath, while the connection according to the invention results in a very uniform temperature while maintaining the connection temperature equal to a value significantly lower than the electrolysis temperature, which reduces electrical, mechanical and chemical stresses on the connection.

Tests

Test 1

A connection test was made with a device similar to that shown in FIG. 5.

In this test, the anode was a cermet for which the ceramic phase comprised a nickel ferrite and the metallic phase was based on copper.

The brazing material was a CuZn alloy with 60% by weight of Cu and 40% by weight of Zn. The melting interval of this alloy was 870 to 900° C. The connection was preheated to 900° C. before the anode was used in an electrolytic cell, for which the bath was based on molten cryolite. Partial melting of the brazing material at the time of preheating was sufficient to make a satisfactory electrical connection. During disassembly, it was observed that the zinc was partly evaporated and oxidised and that use had made a complementary treatment necessary that increased the melting temperature of the joint well above 900° C.

Test 2

A connection test was carried out with a device similar to that shown in FIG. 6.

In this test, the anode was made of cermet with the same composition as in test 1.

The brazing material was a CuZn alloy with 30% by weight of Cu and 70% by weight of Zn. The melting interval of this alloy was 700 to 820° C. The brazing heat treatment was done entirely in situ. It resulted in a brazed joint offering an electrical connection stable in time and with a low electrical resistivity.

In tests 1 and 2, the outside diameter Do of the anode was typically of the order of 70 to 75% of the length L of the anode. The inside diameter D of the anode was also equal to about 60 to 65% of the outside diameter. The thickness E of the sidewall was uniform.

LIST OF NUMERIC MARKS

1. Anode assembly
2. Anode
3. Connection conductor
4. Intermediate connection conductor
4'. Intermediate connection conductor (extension)
5. External connection conductor
6. External connection means
7. Intermediate connection
8. Central cavity of the connection conductor
9. Heating resistance
10. Thermal insulation 20, 20', 20". Anode connection surface
21. Anode cavity
22. Open end
23. Anode wall
23'. Side part of the anode wall
24. Closed end of the anode
25. Anode connection area
26. Collar
27. Annular cavity
28. Annular groove
29. Annular shoulder
30. Conductor/anode connection
31. Brazed metallic joint
31'. Brazing material
32, 32'. Space between connection surfaces of the anode and the conductor
33. Complementary seal
34. Threaded clamping ring
35. Reservoir
36. Ring
37. Attachment means
40, 40', 40". Connection surface of the connection conductor
41. Central cavity of the intermediate connection conductor
42. Connection end
43. Wall of the intermediate connection conductor
44. Annular groove
45. Skirt
46. Annular shoulder
200. Opening
210. Inner surface of the anode
230. Outer surface of the anode
240. Active surface of the anode
340. Clamping ring

The invention claimed is:

1. Anode assembly for use in a fused bath electrolysis aluminum production cell, comprising:

an inert anode in the shape of a ladle, with length L, and comprising a cavity, an open end comprising an opening, a wall surrounding the cavity, a closed end and at least one means for mechanically connecting the inert anode to a connection conductor;

a connection conductor comprising a connection end and means for mechanically connecting the connection conductor to the inert anode, and capable of cooperating with the means for mechanically connecting of the inert anode, so as to create a mechanical linkage between the conductor and the inert anode; and at least one brazed metallic joint or at least one brazing material that can form a brazed metallic joint by brazing wholly or partly during use, the joint or the material being disposed directly between the conductor and the anode, at at least part of at least one anode connection surface at the open end of the inert anode, and at least part of at least one conductor connection surface at the connection end of the conductor.

2. Anode assembly according to claim 1, wherein the means for mechanically connecting of the anode covers part of the open end representing less than 10% of the length L of the anode.

3. Anode assembly according to claim 1, wherein the at least one connection surface of the anode has a total area such that current density per unit area at nominal intensity during use is between 1 and 50 A/cm$^2$.

4. Anode assembly according to claim 1, wherein the means for mechanically connecting of the conductor is adjacent to the connection end.

5. Anode assembly according to claim 1, wherein the means for mechanically connecting of the anode comprises at least one element selected from the group consisting of collars, annular cavities, annular grooves and annular shoulders.

6. Anode assembly according to claim 1, wherein the means for mechanically connecting of the conductor comprises at least one element selected from the group consisting of annular grooves, skirts and annular shoulders.

7. Anode assembly according to claim 1, wherein the means for mechanically connecting of the conductor and the means for mechanically connecting of the anode cooperate through at least one means selected from the group consisting of screwing, click fitting, friction, insertion and force fitting.

8. Anode assembly according to claim 1, additionally comprising at least one complementary assembly means for connecting the anode to the conductor.

9. Anode assembly according to claim 8, wherein the complementary assembly means is selected from the group consisting of clamping rings, open rings and closed rings.

10. Anode assembly according to claim 1, additionally comprising at least one complementary seal constructed and arranged to confine the brazed joint.

11. Anode assembly according to claim 10, wherein the complementary seal is selected from the group consisting of open and closed rings.

12. Anode assembly according to claim 1, wherein the brazed joint has a strength which increases during use of the assembly in an electrolytic aluminium production cell.

13. Anode assembly according to claim 1, wherein the brazed joint includes at least one element selected from the group consisting of aluminium, silver, copper, magnesium, manganese, titanium and zinc.

14. Anode assembly according to claim 1, wherein the connection conductor comprises at least one member made of a nickel based alloy and the connection end is disposed on said member.

15. Anode assembly according to claim 14, wherein the nickel based alloy is a UNS N06625 alloy or a UNS N06025 alloy.

16. Anode assembly according to claim 1, wherein the anode is an anode selected from the group consisting of anodes comprising a ceramic material, anodes comprising a metallic material and anodes comprising a cermet material.

17. Anode assembly according to claim 1, additionally comprising at least one resistance heating element disposed in the cavity of the anode.

18. Cell for aluminum production by fused bath electrolysis, comprising at least one anode assembly according to claim 1.

19. Method for manufacturing an anode assembly, comprising the steps of:

supplying an inert anode in the form of a ladle, with length L, comprising a cavity, an open end comprising an opening, a wall surrounding the cavity, a closed end and at least one means for mechanically connecting the inert anode to a connection conductor;

supplying a connection conductor comprising a connection end, and at least one means for mechanically connecting the connection conductor to the inert anode capable of cooperating with the means for mechanically connecting of the anode, so as to create a mechanical linkage between the conductor and the anode;

supplying a brazing material capable of forming a metallic joint;

placing the brazing material at a predetermined location adjacent to at least one anode connection surface of the open end of the anode or at least one conductor connection surface of the connection end of the conductor, which connection surfaces will be connected by brazing;

assembling the conductor and the anode so as to bring the connection surfaces close to each other; and performing a heat treatment capable of causing formation of a brazed joint directly between the connection surfaces of the conductor and the anode, by means of the brazing material.

20. Method according to claim 19, wherein the assembling of the conductor and the anode produces a loose assembly.

21. Method according to claim 19, wherein the brazing material has a composition which is modified during the heat treatment so as to increase the melting temperature up to a value greater than a maximum temperature applied to the brazed joint during use.

22. Method according to claim 21, wherein the composition of the brazing material is modified by evaporation of at least part of one constituent element thereof.

23. Method according to claim 22, wherein the constituent element is zinc or magnesium.

24. Method according to claim 21, wherein the brazing material has a composition which is modified by chemical reaction of at least part of one constituent element thereof with a constituent of ambient atmosphere.

25. Method according to claim 24, wherein the constituent element of the brazing material is aluminum, zinc, magnesium or phosphorus.

26. Method according to claim 21, wherein the brazing material has a composition which is modified by exchange by diffusion, with or without an oxidation—reduction reaction, of at least one element between the brazing material and one of the connection surfaces.

27. Method according to claim 26, wherein at least a part of the connection surfaces is coated with a material comprising an element that can diffuse in the brazing material.

28. Method according to claim 27, wherein the element which can diffuse into the brazing material is nickel.

29. Method according to claim 26, wherein the brazing material contains at least one element that can be exchanged by at least one oxidation—reduction reaction with the inert anode.

30. Method according to claim 29, wherein the at least one element that can be exchanged is selected from the group consisting of magnesium, aluminium, phosphorus, titanium, zirconium, hafnium and zinc.

31. Method according to claim 21, wherein the brazing material is a mixture or an alloy containing at least one element selected from the group consisting of copper, silver, manganese and zinc.

32. Method according to claim 19, wherein said placing includes introducing at least part of the brazing material between at least part of at least one connection surface of the open end of the anode and at least part of at least one connection surface of the connection end of the conductor.

33. Method according to claim 19, wherein the conductor includes at least one reservoir, the placing step including introducing at least one brazing material into the at least one reservoir before the heat treatment, the conductor and the anode being assembled so as to leave a free space between the conductor and the anode, and the brazing material being introduced between at least part of at least one connection surface of the open end of the anode and at least part of at least one connection surface of the connection end of the conductor by flow of the brazing material during the heat treatment.

34. Method according to claim 19, wherein the connection surfaces are at least partly coated with a material that can be wetted by the brazing material.

35. Method according to claim 19, wherein the heat treatment is at least partly performed while the anode assembly is being used in an electrolytic cell.

36. Method according to claim 19, wherein the connection surfaces adjacent to the opening of the anode are inclined so as to prevent flow of the brazing material into the cavity during brazing and/or use of the anode assembly.

37. Cell for aluminum production by fused bath electrolysis, comprising at least one anode assembly produced using the method according to claim 19.

* * * * *